US006715657B2

(12) United States Patent
Chen

(10) Patent No.: US 6,715,657 B2
(45) Date of Patent: Apr. 6, 2004

(54) MAGAZINE FOR USE IN NAIL STAPLER

(76) Inventor: Mu-Yu Chen, No. 78, Ta Tun 17th Street, Hsi Tun District, Taichung (TW)

( * ) Notice: Subject to any disclaimer, the term of this patent is extended or adjusted under 35 U.S.C. 154(b) by 0 days.

(21) Appl. No.: 10/133,277

(22) Filed: Apr. 29, 2002

(65) Prior Publication Data

US 2003/0201300 A1 Oct. 30, 2003

(51) Int. Cl.[7] ..... B25C 3/00
(52) U.S. Cl. ..... 227/120; 227/109; 227/130
(58) Field of Search ..... 227/109, 120, 227/123, 127, 130, 134, 135

(56) References Cited

U.S. PATENT DOCUMENTS 4,749,115 A * 6/1988 Fehrs ..... 227/109
4,815,647 A * 3/1989 Chou ..... 227/109
5,368,213 A * 11/1994 Massari, Jr. ..... 227/123
5,632,431 A * 5/1997 Lin ..... 227/109
5,695,108 A * 12/1997 Lee ..... 227/109
5,794,832 A * 8/1998 Chen ..... 227/109
5,873,509 A * 2/1999 Liao ..... 227/109
6,092,711 A * 7/2000 Tinarelli ..... 227/109

* cited by examiner

*Primary Examiner*—Scott A. Smith
*Assistant Examiner*—Nathaniel Chukwurah
(74) *Attorney, Agent, or Firm*—Charles E. Baxley

(57) ABSTRACT

A nail stapler magazine includes a storage device for storing nails and staples, a feeder device for feeding the nails and the staples in the storage device, a gate device through which the nails and the staples can be fed, and a distinguisher device for distinguishing the nails from the staples and ensuring that that only one of the nails and staples is fed at a time.

23 Claims, 6 Drawing Sheets

MAGAZINE FOR USE IN NAIL STAPLER

BACKGROUND OF INVENTION

1. Field of Invention

The present invention is related to a nail stapler and, more particularly, to a magazine for use in a nail stapler.

2. Related Prior Art

In ancient time, a hammer was the only effective tool for driving a nail into two pieces of wood in order to fasten them together. Later on, a nail stapler was invented. Since then, a lot of nail staplers have been devised.

U.S. Pat. No. 5,368,213 teaches a nail stapler magazine capable of providing single-legged nails (or "nails"); however, it cannot provide U-shaped nails (or "staples").

U.S. Pat. No. 5,632,431 issued to the applicant of the present patent application teaches a nail stapler magazine capable of providing both nails and staples. However, in the case of a jam, a nail or stale cannot be removed from the nail stapler easily.

The present invention is therefore intended to obviate or at least alleviate the drawbacks encountered in using conventional decorative device.

SUMMARY OF INVENTION

It is an objective of the present invention to provide a nail stapler magazine that can contain nails and staples simultaneously and provide nails or staples automatically without the need for manual adjustment thereof.

It is another objective of the present invention to provide a nail stapler magazine from which a nail or staple can be easily removed in the case of jam.

According to the present invention, a nail stapler magazine includes a storage device for storing nails and staples, a feeder device for feeding the nails and the staples in the storage device, a gate device through which the nails and the staples can be fed, and a distinguisher device for distinguishing the nails from the staples and ensuring that that only one of the nails and staples is fed at a time.

The storage device includes first and second shells engaged with each other so as to define a space for storing the nails and the staples. The first and second shells both define a plurality of grooves for receiving and guiding the heads of the nails. The first shell defines a channel for receiving a terminal section of each staple. The space defined between the first and second shells receives another terminal section of each staple.

The feeder device includes a feeder for feeding the nails and the staples. The feeder device includes at least one spring for biasing the feeder. The feeder device includes at least one joint for connecting the at least one spring with the feeder. The first shell defines at least one tunnel for receiving the at least one spring and the at least one joint. The at least one spring is helical. The at least one joint includes a stem inserted in the at least one spring. The feeder includes at least one tab formed thereon for engagement with the at least one joint. The at least one joint defines a recess for receiving the at least one tab formed on the feeder. The feeder includes two side sections and an intermediate section formed between the side sections. One side section of the feeder is received in the space defined between the first and second shells and the other side section of the feeder is received in the channel defined in the first shell.

The gate device includes a first plate attached to an end of the first shell and a second plate attached to the distinguisher device. The first plate defines a plurality of recesses corresponding to the grooves defined in the first shell. The second plate defines a plurality of recesses corresponding to the grooves defined in the second shell. The first plate defines a slot for receiving a terminal section of each staple.

The distinguisher device includes a plate and a stop formed on the plate for stopping a terminal section of each staple. The plate of the distinguisher device defines a slot for receiving the stop.

The stop is pivotally mounted on the plate. The distinguisher device includes an elastic element attached to the plate thereof for biasing the stop. The distinguisher device includes a block formed on the plate thereof, crossing the slot, for limiting the pivot of the stop. A pin is inserted in a hole defined in the protrusion from the stop for limiting the pivot of the stop.

BRIEF DESCRIPTION OF DRAWINGS

The present invention will be described through detailed illustration of embodiments referring to the attached drawings wherein.

DETAILED DESCRIPTION OF PREFERRED EMBODIMENTS

Figure 1:
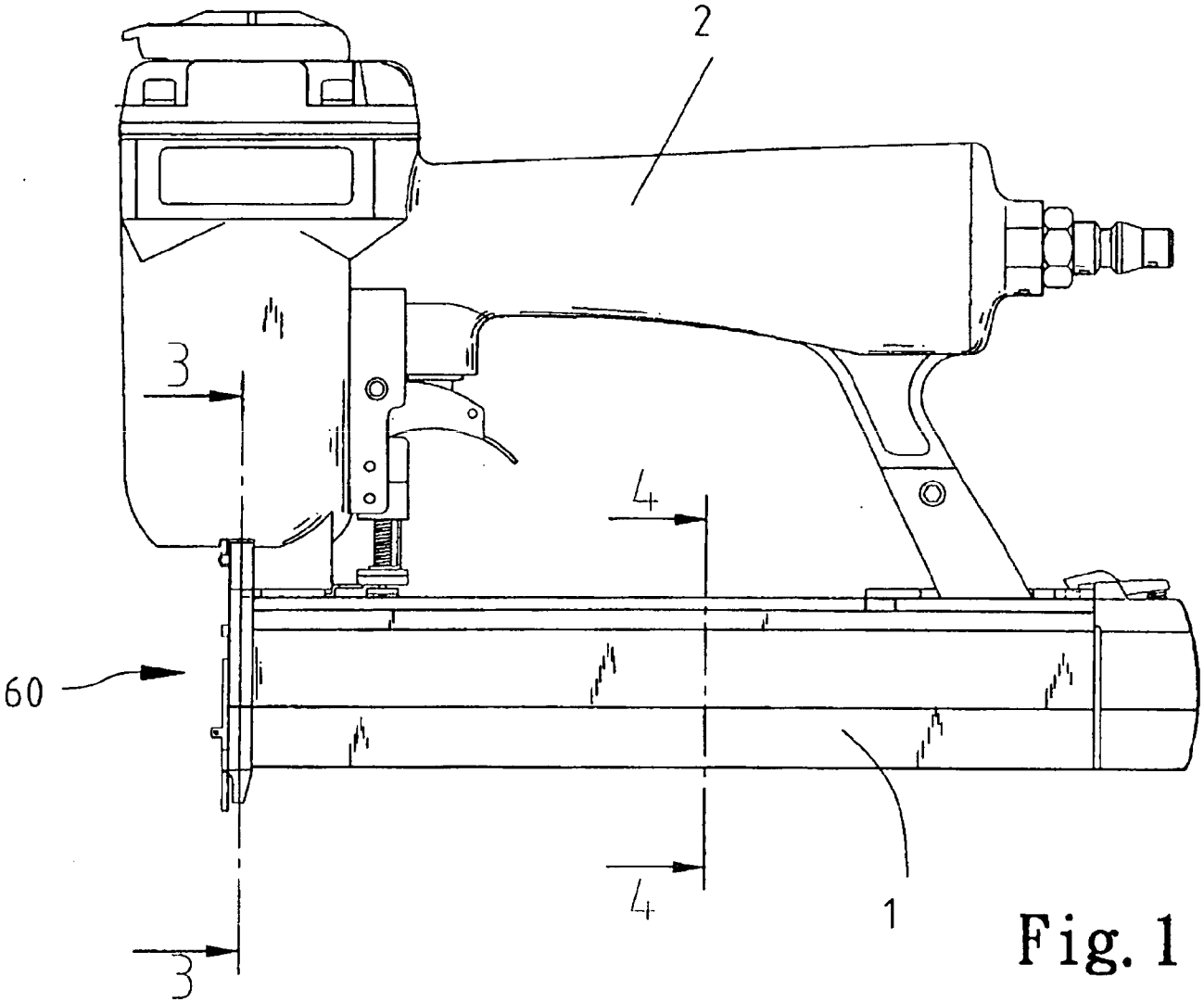
FIG. 1 is a side view of a nail stapler with a magazine according to the present invention.

Referring to FIG. 1, the present invention provides a magazine 1 for a nail stapler 2. The magazine 1 can store and feed nails 100 (see FIG. 3) and staples 110 (see FIG. 4) so that the nail stapler 2 can shoot one nail 100 or staple 110 from the magazine 1 at a time.

Figure 2:
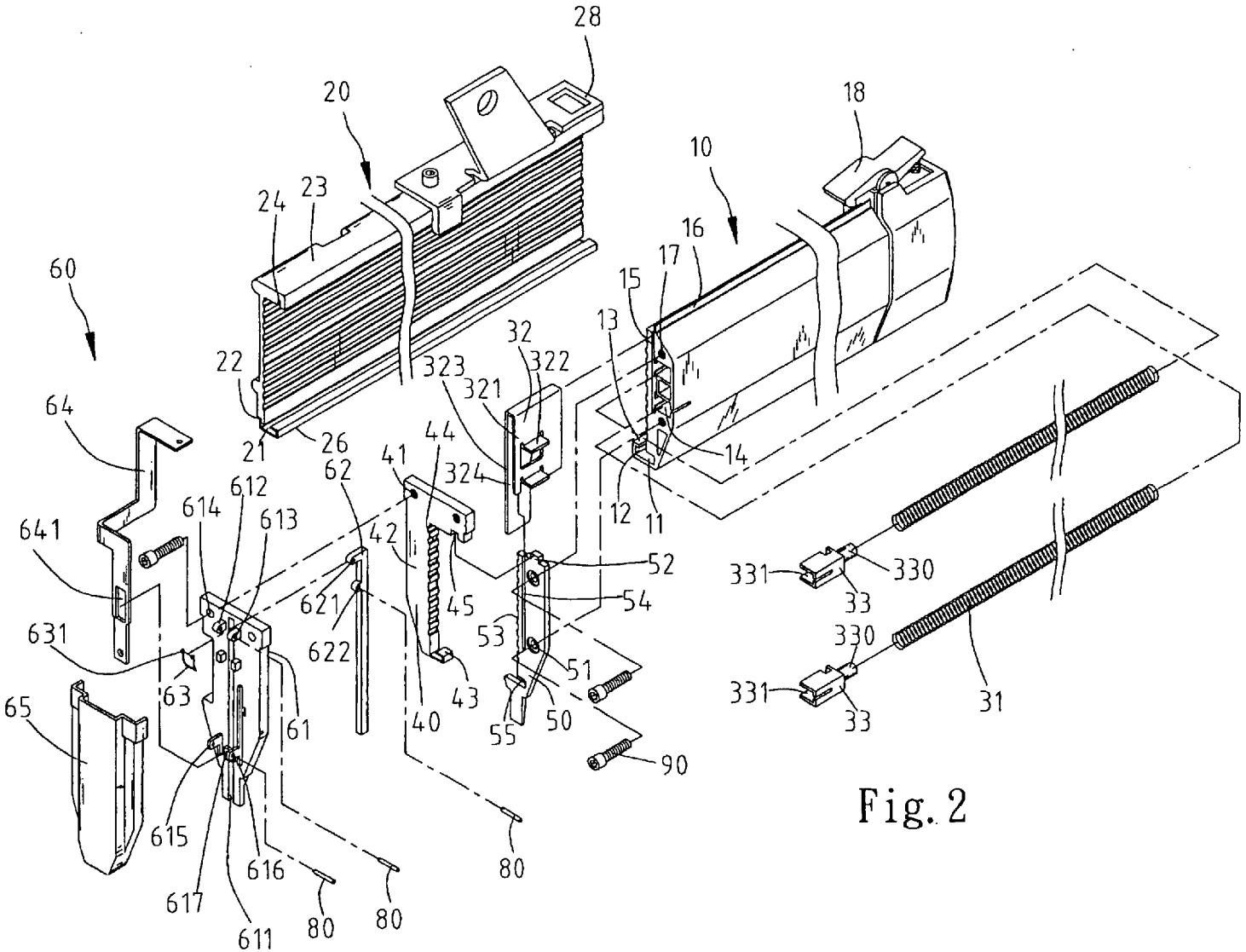
FIG. 2 is an exploded view of the magazine shown in FIG. 1.

Referring to FIG. 2, the magazine 1 includes a storage device (not numbered) for storing the nails 100 and/or the staples 110, a feeder device (not numbered) for feeding the nails 100 and/or the staples 110 in the storage device, a gate device (not numbered) through which the nails 100 and the staples 110 can be fed and a distinguisher device 60 for distinguishing the nails 100 from the staples 110 and ensuring that that only one nail 100 or staple 110 is fed at a time.

The storage device consists of a first shell 10 and a second shell 20. The first shell 10 can be engaged with the second shell 20 so as to define a space 70 (see FIG. 4) for storing the nails 100 and staples 110.

The first shell 10 includes an internal wall and an external wall, wherein the internal wall faces the nails 100 and the external wall is opposite to the internal wall. The internal wall of the first shell 10 defines a plurality of parallel grooves (not numbered) for receiving and guiding the heads of the nails 100. The first shell 10 includes front and rear walls and upper and lower edges. The first shell 10 includes a groove 11 defined in the internal wall, near and parallel to the lower edge. The groove 11 can receive a correspond portion of the second shell 20 to be described. The first shell 10 includes a clip 12 extending from the internal wall, near the lower edge and the front face. The clip 12 extends horizontally, then upwards, and finally horizontally towards the internal wall of the shell 10. The clip 12 includes an edge 13 for engagement with a corresponding portion of the second shell 20 to be described. The first shell 10 defines two tunnels 14 parallel to the upper and lower edges. The first shell 10 includes a channel 15 defined in the upper edge, extending deeply into the shell 10 so as to communicate the tunnels 14 with each other. The first shell 10 includes a fin 16 extending upwards from the upper edge for engagement with a corresponding of the second shell 20 to be described. The first shell 10 includes two threaded apertures 17 defined in the front face, one above the upper tunnel 14 and the other below the lower tunnel 14.

The second shell 20 includes an internal wall and an external wall, wherein the internal wall faces the nails 100 and the external wall is opposite to the internal wall. The internal wall of the second shell 20 defines a plurality of parallel grooves (not numbered) for receiving and guiding the heads of the nails 100. The second shell 20 includes front and rear edges and upper and lower edges. The second shell 20 includes a lower strip 26 extending from the internal wall, near the lower edge. The lower strip 26 is used for engagement with the groove 11. The second shell 20 includes a groove 21 defined in the internal wall thereof, near the lower strip 26. The external internal wall of the second shell 20 defines a groove 22, near and parallel to the lower edge. The groove 22 can be engaged with the edge 13. The second shell 20 includes an upper strip 23 extending horizontally from the internal wall, near the upper edge. The upper strip 23 includes a groove 24 defined in a lower face thereof for engagement with the fin 16.

In assembly of the shells 10 and 20, the lower strip 26 is inserted in the groove 11, the edge 13 is received in the groove 22, and the fin 16 is received in the groove 24. The shells 10 and 20 can be retained assembled by means of a buckle including a hook 18 pivotally mounted on the first shell 10 and a ring 28 secured to the second shell 20 for receiving the hook 18.

The feeder device includes two springs 31, a feeder 32 biased by the springs 31 and two joints 33 for connecting the springs 31 with the feeder 32. The springs 31 are helical. Each of the joints 33 includes a stem 330, and defines a recess 331. The feeder 32 including a side section 321, a side section 323 parallel to the side section 321 and an intermediate section (not numbered) formed between the side sections 321 and 323, thus defining a space 324 between them. Two tabs 322 extend horizontally from the side section 321. In assembly, each of the stems 330 is inserted in an end of one of the springs 31. Each pair of spring 31 and joint 33 is received in one of the tunnels 14. The side section 321 of the feeder 32 is inserted in the channel 15. The tabs 322 are received in the tunnels 14. Thus, the feeder 32 can move between the shells 10 and 20. The tabs 322 are received in the recesses 331. Thus, the springs 31 are engaged with the feeder 32 by means of the joints 33.

The gate device includes plates 40 and 50. The plate 40 includes a vertical section, an upper horizontal section extending from the vertical section and a lower horizontal section 43 extending from the vertical section. The vertical section of the plate 40 includes a number of recesses 44 defines in an edge thereof for receiving the heads of the nails 100. Two threaded holes 41 are defined in the upper horizontal section of the plate 40. The upper horizontal section of the plate 40 includes a recess 45 defined in a lower edge thereof. The plate 40 is connected with the distinguisher device 60 to be described.

The plate 50 includes two holes 51 defined therein, a tab 52 extending from an upper end thereof, and a number of recesses 53 defined therein an edge thereof, corresponding to the recesses 44. The plate 50 includes a slot 54 defined therein, extending between the holes 51 and the recesses 53. The plate 50 includes a recess 55 defined therein, extending horizontally below the recesses 53. A threaded bolt 90 inserted through one of the holes 51 is engaged with a corresponding one of the threaded holes 17, thus affixing the plate 50 to the front edge of the first shell 10. The side section 321 of the pusher 32 is allowed to pass through the slot 54. Two threaded bolts 90 are inserted through the holes 51 for engagement with the threaded holes 17, thus securing the plate 50 to the first shell 10.

The distinguisher device 60 includes a plate 61, a cane-shaped stop 62 pivotally mounted on the plate 61 and a U-shaped spring 63 for limiting pivot of the cane-shaped stop 62 on the plate 61. The plate 61 defines a slot 611.

The plate 61 includes two upper lugs 612 between which the slot 611 is located. Each of the upper lugs 612 defines a hole 613. Tow holes 614 are defined in the plate 61, corresponding to the holes 41. The plate 61 includes two lower lugs 615 between which the slot 611 is located. Each of the lower lugs 615 defines a hole 616. A block 617 is formed on the plate 61, crossing the slot 611.

A threaded bolt 90 is inserted through each of the holes 614 for engagement with one of the threaded holes 41, thus combining the plate 61 with the plate 41.

The cane-shaped stop 62 includes a vertical section and upper and lower horizontal sections projecting in a same direction from the vertical section. A hole 621 is defined in the upper horizontal section of the cane-shaped stop 62. A hole 622 is defined in the lower horizontal section of the cane-shaped stop 62.

The U-shaped spring 63 includes two ends each defining a hole 631.

In assembly, the vertical section of the cane-shaped stop 62 is received in the slot 611. The upper horizontal section of the cane-shaped stop 62 is located between the lugs 612. A pin 80 is inserted in the holes 613, 631 and 621, thus pivotally mounting the cane-shaped stop 62 and the spring 63 on the upper lugs 612 of the plate 61. The vertical section of the cane-shaped stop 62 is biased into the slot 611 by means of the U-shaped spring 63. A pin 80 is inserted in the hole 621. Thus, the cane-shaped stop 62 can only pivot in a small range due to the pin 80 secured to the lower horizontal section of the cane-shaped stop 62 and the block 617.

A security element 64 includes a hole 641 defined in a proper position thereof. The security element 64 is located next to the plate 61. The block 617 is received in the slot 641. A pin 80 is inserted in the holes 616. Thus, the security member 64 can only move vertically with respect to the plate 61. The security element 64 includes an upper section connected with the nail stapler 2 so that the nail stapler 2 cannot be triggered unless the security element 64 is pushed to an upper limit as the magazine 1 is pressed against a surface of wood.

A cover 65 configured corresponding to the plate 61 is mounted on the plate 61, thus covering the security element 64 and the plate 61 for aesthetic purposes.

Figure 3:
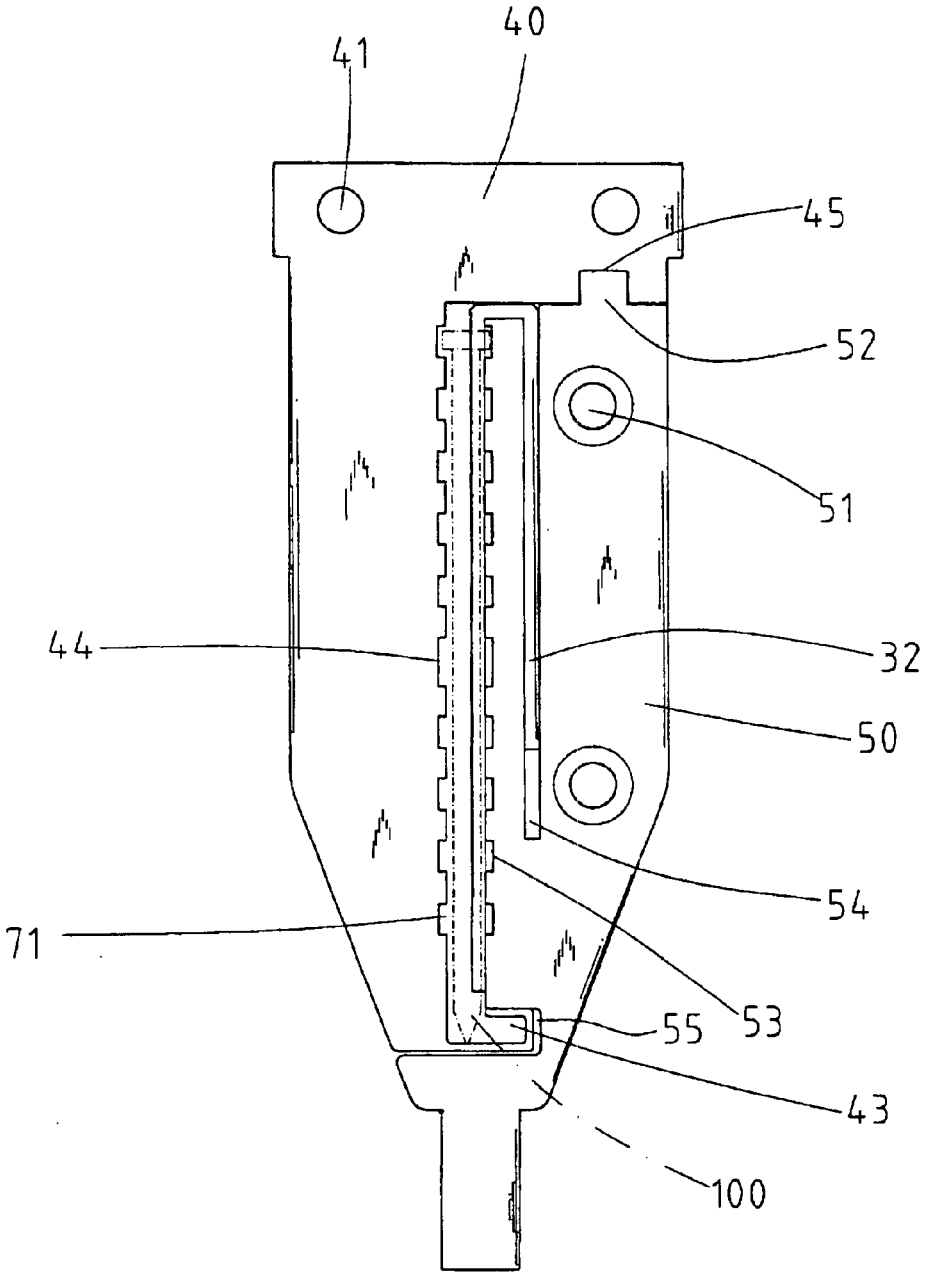
FIG. 3 is a cross-sectional view of the magazine taken along a line 3—3 in FIG. 1.
Figure 4:
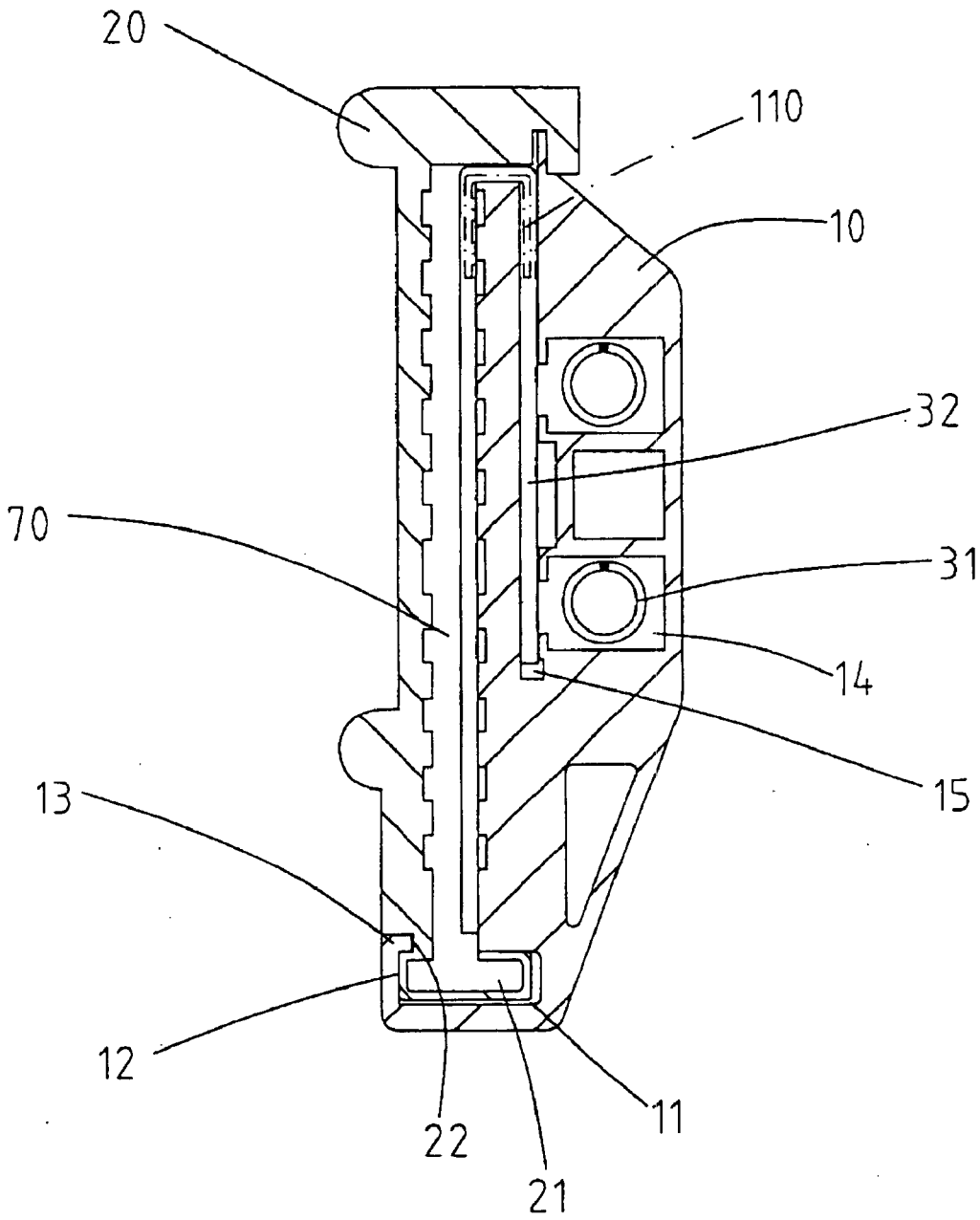
FIG. 4 is a cross-sectional view of the magazine taken along a line 4—4 in FIG. 1.

Referring to FIG. 3, the nails 100 are received in the magazine 1. One of the grooves defined in the internal wall of the first shell 10 cooperates with one of the grooves defined in the internal wall of the shell 20 in order to receive the heads of the nails 100. The nails 100 can be moved through a space 71 defined between the plates 40 and 50. Referring to FIG. 4, the staples 110 are received in the magazine 1. A terminal section of each staple 110 is received in the space 70 while the other section of each staple 110 is received in the channel 15. Obviously, the nails 100 and the staples 110 can be simultaneously stored in the magazine 1.

Figure 5:
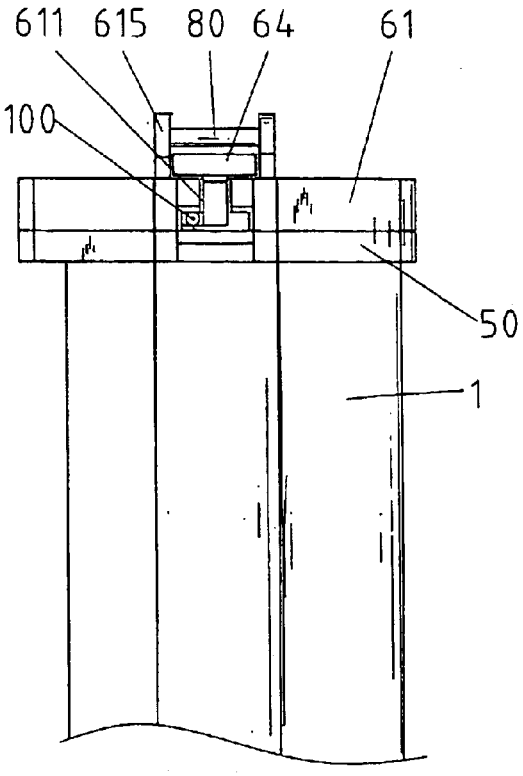
FIG. 5 is a bottom view of the magazine shown in FIG. 1 feeding nails.
Figure 6:
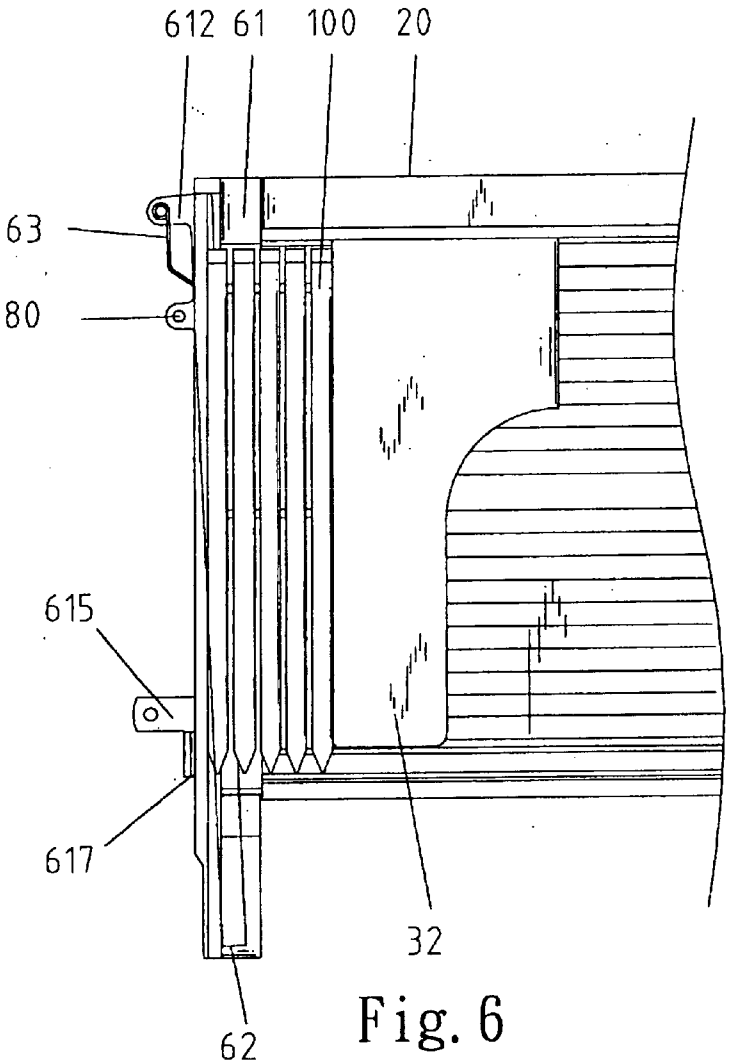
FIG. 6 is a cross-sectional view taken along a line 6—6 in FIG. 5.

Referring to FIGS. 5 and 6, a leading one of the nails 100 is pushed beyond the cane-shaped stop 62 by means of the feeder 32. Thus, the leading nail 100 can be provided to wood (not shown) from the magazine 1 by means of the nail stapler 2.

Figure 7:
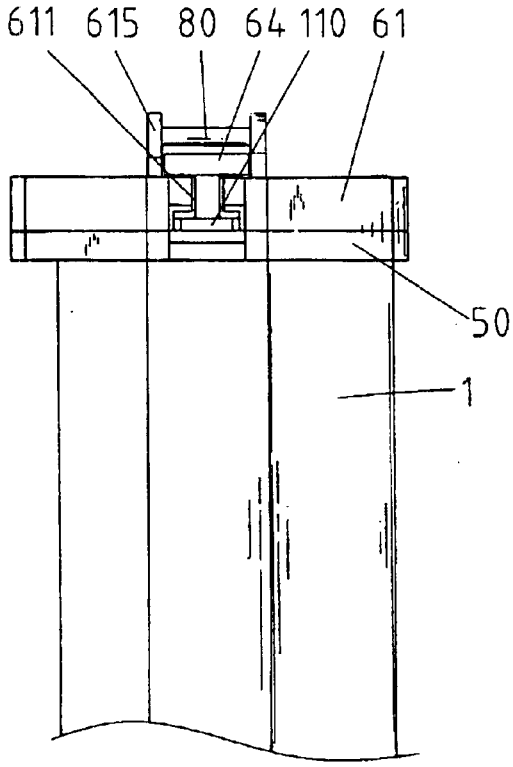
FIG. 7 is a bottom view of the magazine shown in FIG. 1 feeding staples.
Figure 8:
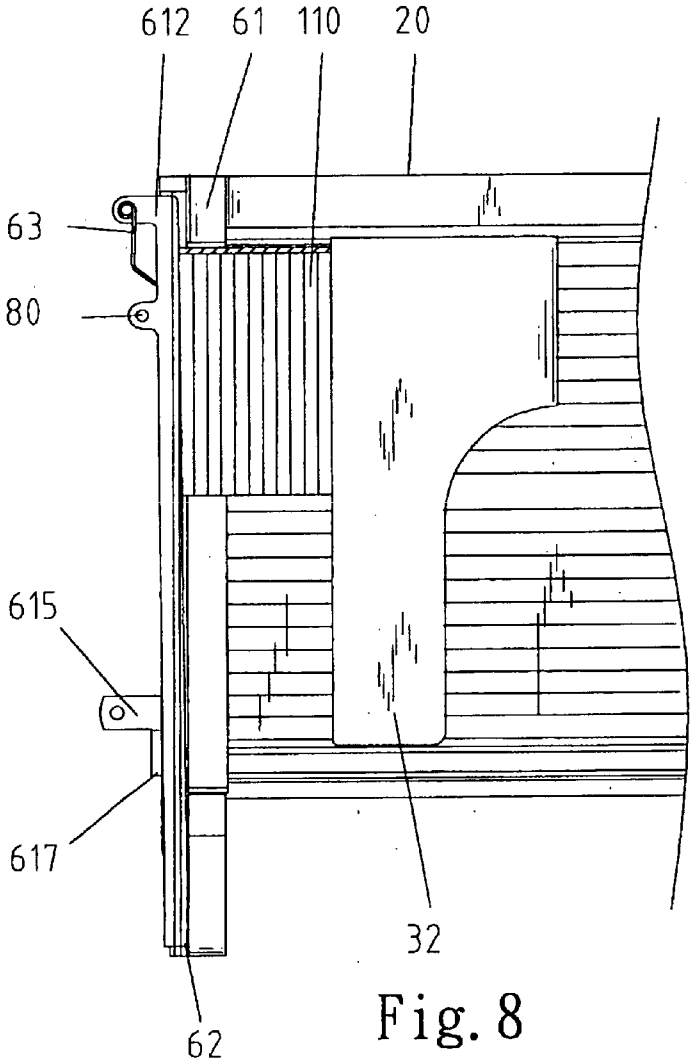
FIG. 8 is a cross-sectional view taken along a line 8—8 in FIG. 1.

Referring to FIGS. 7 and 8, a leading one of the staples 110 is pushed against the cane-shaped stop 62 by means of the feeder 32. Due to the cane-shaped stop 62, only the leading staple 110 can be pushed beyond the gate device consisting of plates 40 and 50. Thus, only the leading staple 110 can be provided to wood (not shown) from the magazine 1 by means of the nail stapler 2.

The magazine according to the present invention provides two advantageous features. Firstly, it can simultaneously contain nails and staples and automatically provide nails or staples without the need for manual adjustment thereof. Thus, a user does not have to buy two nail staplers adapted for storing and feeding nails and staplers, respectively. Secondly, when it is jammed with a nail or staple, the nail or staple can be easily removed from it since the plate 50 can be disengaged from the plate 40.

The present invention has been described through detailed illustration of the preferred embodiment thereof. Those skilled in the art can derive many variations from the preferred embodiment without departing from the scope of the present invention. Therefore, the preferred embodiment shall not limit the scope of the present invention. The scope of the present invention can only be defined in the attached claims.

What is claimed is:

1. A nail stapler magazine including a storage device including first and second shells (10, 20) engaged with each other so as to define a space (70) for storing nails (100) and staples (110), a feeder device for feeding the nails (100) and the staples (110) from the storage device, a gate device through which the nails (100) and the staples (110) can be fed and a distinguisher device (60) for distinguishing the nails (100) from the staples (110) and ensuring that that only one of the nails and staples (100; 110) is fed at a time, wherein the gate device includes a first plate (50) that is attached to the first shell (10) and defines a slot (54) for receiving a terminal section of each staple (110) and a second plate (40) attached to the distinguisher device (60) so as to define a gap between the first and second plates (40; 50) for receiving the other terminal section of each staple (110).

2. The nail stapler magazine as set forth in claim 1 wherein the first and second shells (10, 20) both define a plurality of grooves for receiving and guiding the heads of the nails (100).

3. The nail stapler magazine as set forth in claim 1 wherein the first shell (10) defines a channel (15) for receiving a terminal section of each staple (110) while the space (70) defined between the first and second shells (10, 20) receives another terminal section of reach staple (110).

4. The nail stapler magazine as set forth in claim 1 wherein the second shell 20 includes a strip (26) formed thereon, wherein the first shell (10) defines a groove (11) for receiving the strip (26) formed on the first shell (10).

5. The nail stapler magazine as set forth in claim 4 wherein the feeder device includes a feeder (32) with two side sections and an intermediate section formed between the side sections, wherein one side section of the feeder (32) is received in the space (70) defined between the first and second shells (10, 20) and the other side section of the feeder (32) is received in the channel (15) defined in the first shell (10).

6. The nail stapler magazine as set forth in claim 1 wherein the first shell (10) includes a clip (12) formed thereon for clamping the second shell (20).

7. The nail stapler magazine as set forth in claim 6 wherein the clip (12) includes an edge (13), wherein the second shell (20) defines a groove (22) for receiving the edge (13) of the clip (12).

8. The nail stapler magazine as set forth in claim 1 wherein the first shell (10) includes a fin (16) formed thereon, wherein the second shell (20) defines a groove (24) for receiving the fin (16).

9. The nail stapler magazine as set forth in claim 1 wherein the feeder device includes a feeder (32) for feeding the nails (100) and the staples (110).

10. The nail stapler magazine as set forth in claim 9 wherein the feeder device includes at least one spring (31) for biasing the feeder (32).

11. The nail stapler magazine as set forth in claim 10 wherein the first shell (10) defines at least one tunnel (14) for receiving the at least one spring (31).

12. The nail stapler magazine as set forth in claim 10 wherein the feeder device includes at least one joint (33) for connecting the at least one spring (31) with the feeder (32).

13. The nail stapler magazine as set forth in claim 12 wherein the at least one spring (31) is helical, wherein the at least one joint (33) includes a stem (330) inserted in the at least one spring (31).

14. The nail stapler magazine as set forth in claim 13 wherein the feeder (32) includes at least one tab (322) formed thereon for engagement with the at least one joint (33).

15. The nail stapler magazine as set forth in claim 14 wherein the at least one joint (33) defines a recess (331) for receiving the at least one tab (322) formed on the feeder (32).

16. The nail stapler magazine as set forth in claim 1, wherein the first plate (50) defines a plurality of recesses (53) corresponding to the grooves defined in the first shell (10), wherein the second plate (40) defines a plurality of recesses (44) corresponding to the grooves defined in the second shell (20).

17. The nail stapler magazine as set forth in claim 16 wherein the first plate (50) includes a tab (52) formed thereon, wherein the second plate (40) defines a recess (45) for receiving the tab (52) formed on the first plate (50).

18. The nail stapler magazine as set forth in claim 16 wherein the second plate (40) includes a strip (43) formed thereon, wherein the first plate (50) defines a recess (55) for receiving the strip (43) formed on the second plate (40).

19. A nail stapler magazine comprising a storage device for storing nails (100) and staples (110), a feeder device for feeding the nails (100) and the staples (110) from the storage device, a gate device through which the nails (100) and the staples (110) can be fed; and a distinguisher device (60) for distinguishing the nails (100) from the staples (110) and ensuring that that only one of the nails and staples (100; 110) is fed at a time, the distinguisher device (60) including a plate (61) defining a slot (611), a stop (62) attached to the plate (61) and pivoted in the slot (611) for stopping a terminal section of each staple (110) and a block (617) attached to the plate (61), crossing the slot (611), for limiting the pivotal of the stop (62).

20. The nail stapler magazine as set forth in claim 19 wherein the stop (62) is pivotally mounted on the plate (61).

21. The nail stapler magazine as set forth in claim 19 wherein the distinguisher device (60) includes an elastic element (63) attached to the plate (61) for biasing the stop (62).

22. The nail stapler magazine as set forth in claim 19 wherein the plate (61) includes two upper lugs (612) each defining a hole (613) for receiving a pin (80) inserted through a hole (621) defined in the stop (62).

23. The nail stapler magazine as set forth in claim 22 wherein the stop (62) includes an extension formed thereon and a hole (622) defined in the extension for receiving a pin (80) for limiting the pivot of the stop (62).

* * * * *